US005349144A

United States Patent [19]

Baragar

[11] Patent Number: 5,349,144

[45] Date of Patent: Sep. 20, 1994

[54] TRANSFORMER CONNECTOR

[75] Inventor: James B. Baragar, Mississauga, Canada

[73] Assignee: Marglass Industries Limited, Ontario, Canada

[21] Appl. No.: 965,846

[22] Filed: Oct. 22, 1992

[51] Int. Cl.[5] ..... H01R 13/00; H01H 3/00; H01H 9/26

[52] U.S. Cl. ..... 200/18; 200/50 C; 439/480

[58] Field of Search ..... 200/1 R, 1 A, 17 R, 200/18, 50 R, 50 B, 50 C; 439/188, 472, 478, 480, 481, 801

[56] References Cited

U.S. PATENT DOCUMENTS

| | | | |
|---|---|---|---|
| 3,041,574 | 6/1962 | Cornell, Jr. | 339/94 |
| 3,103,560 | 9/1963 | Bridges | 200/50 C |
| 3,344,382 | 9/1967 | Olive, Jr. et al. | 336/107 |
| 3,377,487 | 4/1968 | McNulty | 307/17 |
| 3,612,750 | 10/1971 | Monico et al. | 174/145 |
| 3,710,307 | 1/1973 | Cooper, Jr. | 339/116 C |
| 3,895,853 | 7/1975 | Neidecker | 339/272 R |
| 3,918,786 | 11/1975 | Chaney et al. | 339/19 |
| 4,017,699 | 4/1977 | Hellman | 200/67 D |
| 4,787,855 | 11/1988 | Finke | 439/92 |
| 4,946,394 | 8/1990 | Knapp et al. | 439/157 |
| 4,952,898 | 8/1990 | Nelson et al. | 336/65 |
| 5,085,583 | 2/1992 | Amos et al. | 439/479 |

*Primary Examiner*—Marc S. Hoff
*Assistant Examiner*—Michael A. Friedhofer
*Attorney, Agent, or Firm*—Burns, Doane, Swecker & Mathis

[57] ABSTRACT

A connector for installation between utility transformer secondary leads and service leads. The connector is for location below a pole-mounted transformer and may be opened or closed from the ground with the use of a tool such as a hot stick. The connector includes two switches for releasable electrical connection of the secondary and service leads. Each switch has a rigid immovable member, a movable member and fastener. The movable member may be brought into contact with and fastened in electrical connection with the rigid member for a closed position of the switch. The fastener may be released and the movable member moved out of electrical contact with the rigid member for an open position of the switch. There are two embodiments disclosed. In the disclosed embodiments, the movable member of each switch includes a flexible cable and the connector includes a spacer between the cables to prevent electical connection therebetween when the switches are open. The flexible member of each switch has a rigid portion, such as a Z-bar, having an aperture which registers with an aperture in the flexible member. A bolt fastener is inserted through these apertures and threaded into a threaded hole in the rigid member of the switch for electrical connection of the members.

33 Claims, 6 Drawing Sheets

TRANSFORMER CONNECTOR

FIELD OF THE INVENTION

This invention relates to releasable connectors for installation between utility transformer secondary leads and consumer service leads.

BACKGROUND OF THE INVENTION

The primary winding of a transformer is generally disconnected from its power source prior to servicing. For safety's sake or for other reasons, it may be desirable or required that the secondary winding also be disconnected. A possible reason for this is the existence of a consumer power source connected to the transformer through the secondary leads. If power is supplied to the secondary winding from such a source, the power can be stepped up in the transformer and create a hazard for utility workers. In fact, utility workers are known to have been killed by coming into contact with such a stepped up voltage. Such sources may be unknown to utility workers and present a hidden danger. An example of such an unknown power source is backfeed from the generator of a recreational vehicle connected to the wiring of a house included in a transformer's service. There are other known possible sources.

In Australia, the State Electricity Commission of Victoria (SECV) is known to mount single-pole isolator switches underslung on a crossarm supporting a 230/400 volt three-phase, four-wire secondary conductors. This arrangement provides for the disconnection of both the primaries and secondaries for complete transformer isolation. The arrangement is unsatisfactory for North American utilities.

A multiple bushing connector apparatus for a pad-mount transformer is described in U.S. Pat. No. 4,787,855, issued Nov. 29, 1988. Use of the apparatus has the disadvantage of relying on releasable bushing connections between the transformer and external leads.

GENERAL DESCRIPTION OF THE INVENTION

The present invention provides a connector for installation between secondary leads of a pole-mounted utility transformer and service leads.

In one broad aspect, the invention provides a connector having two spaced apart switches. Each switch has an open and a closed position. When both switches are closed, the transformer is electrically connected to its service. When both switches are open, the transformer is electrically isolated from its service. There is an electrically non-conductive spacer provided between the switches to preclude electrical connection therebetween. Preferably, each switch includes a rigid conductive member, a flexible conductive member and a releasable fastener for connecting and disconnecting the members. The spacer is secured between the flexible members of the switches and precludes electrical contact, i.e., shorting therebetween. Preferably, each flexible member is biased away from the rigid member to maintain electrical disconnection when a switch is open.

In another broad aspect, the invention provides a connector having spaced apart switches in which each switch has rigid and flexible members, and the flexible member has a rigid portion connected to it. The rigid portion has a flange with a hole in it arranged such that the hole registers with an aperture in the flexible member. The aperture of the flexible member may be registered with a threaded aperture of the rigid member of the switch and a threaded fastener may thus be inserted through the hole and aperture of the flexible member to be axially aligned for threading into the threaded aperture of the rigid member for fastening of the switch in its closed position.

In the disclosed embodiments, each flexible member has a rigid portion connected to it and the rigid portion has an apertured flange spaced from the flexible portion. There is an aperture in each flexible member which registers with the flange aperture so that a bolt fastener may be inserted through the apertures. There is a threaded aperture in the rigid member of each switch for receipt the bolt. The arrangement is such that the pair of registering apertures of the flexible portion of the switch align the bolt for threading of the bolt into the threaded aperture of the rigid member. Further, in the preferred embodiments, the rigid spacer between the flexible members assists in locating the flexible and rigid members so that each bolt is also centered with respect to the aperture into which it is to be threaded.

DETAILED DESCRIPTION OF PREFERRED EMBODIMENTS

Figure 1:
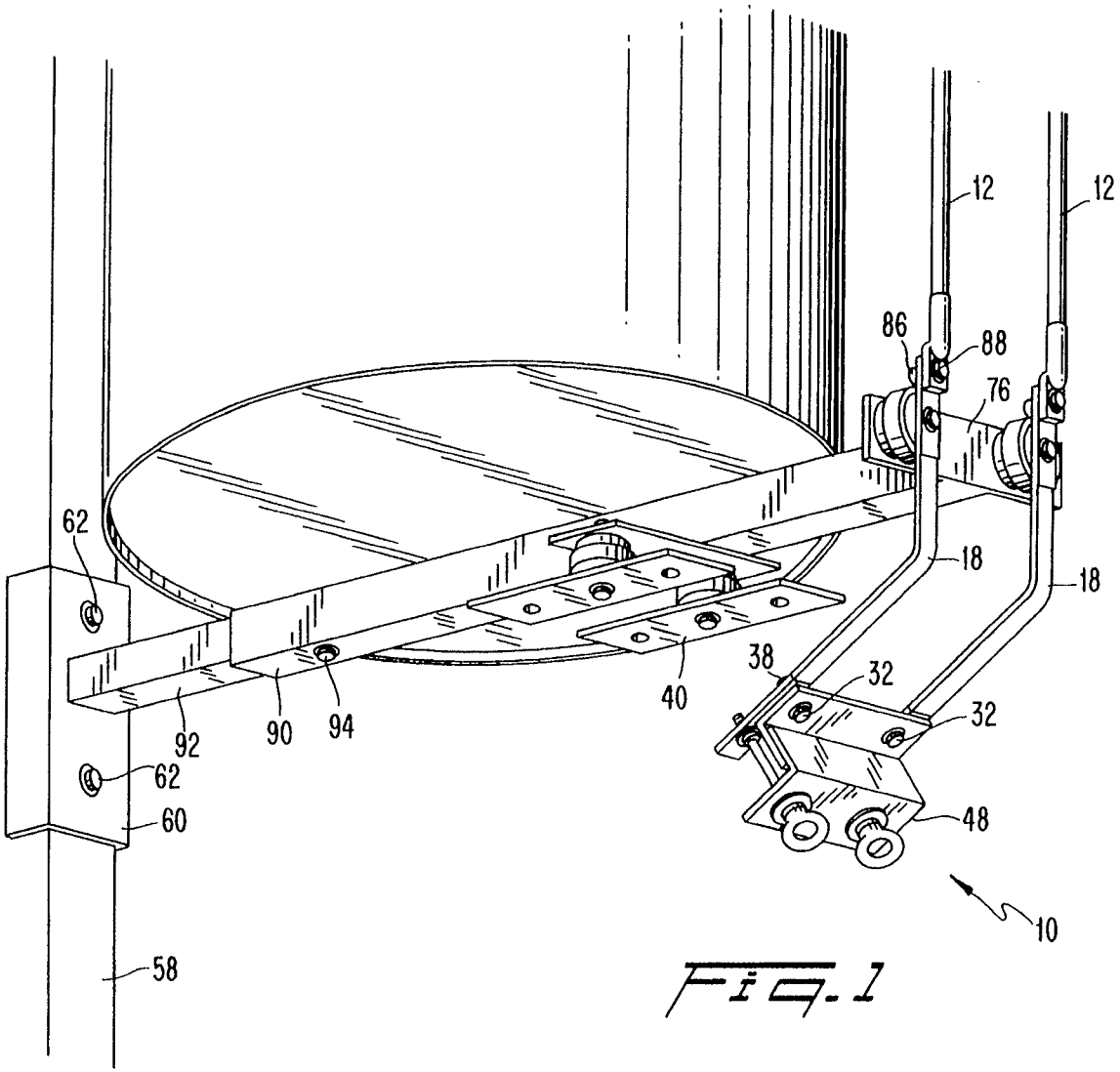
FIG. 1 shows a preferred embodiment connector of the present invention installed with a conventional pole-mounted transformer, the connector being in an open position.
Figure 2:
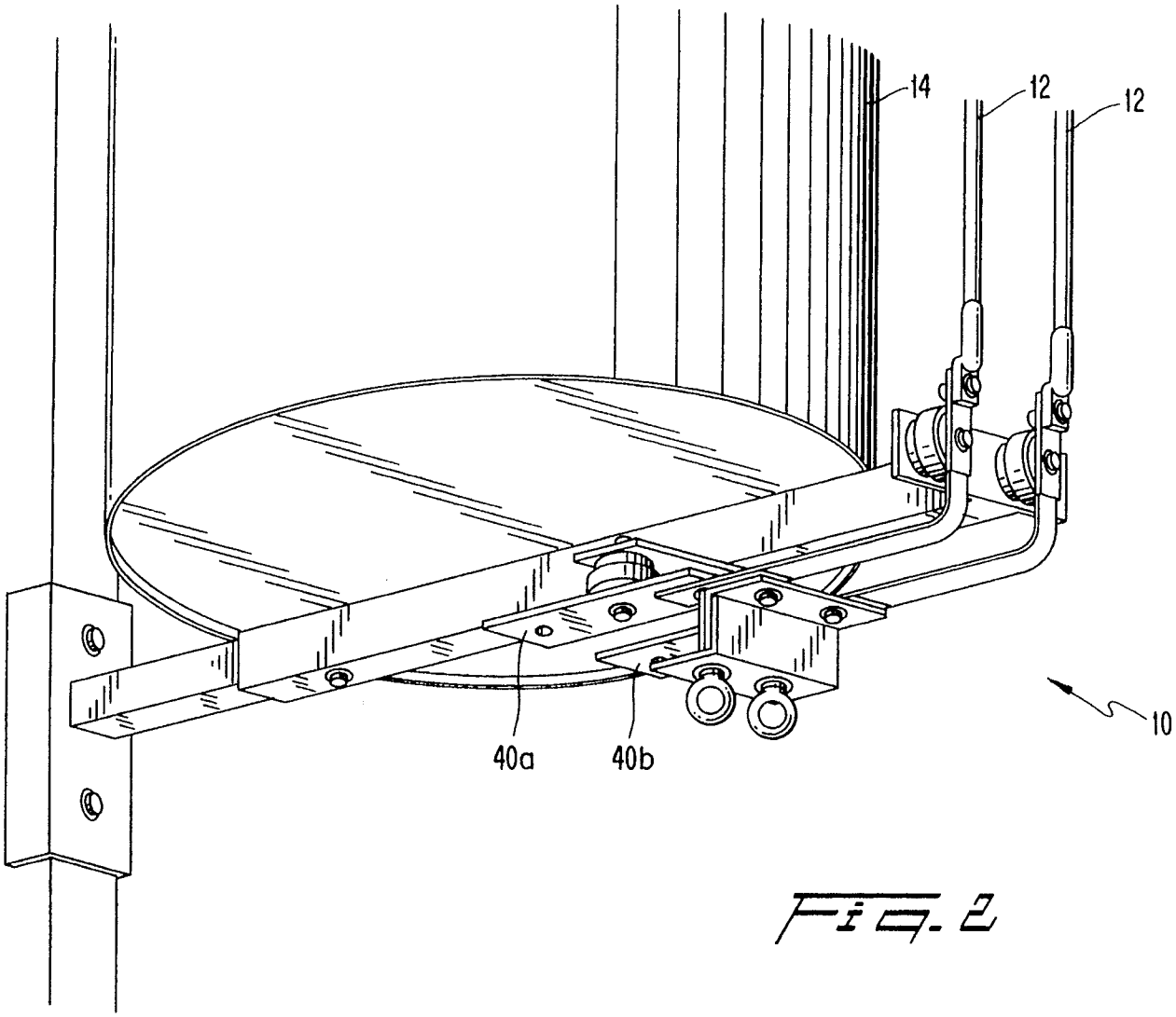
FIG. 2 shows the FIG. 1 embodiment in a closed position.
Figure 3:
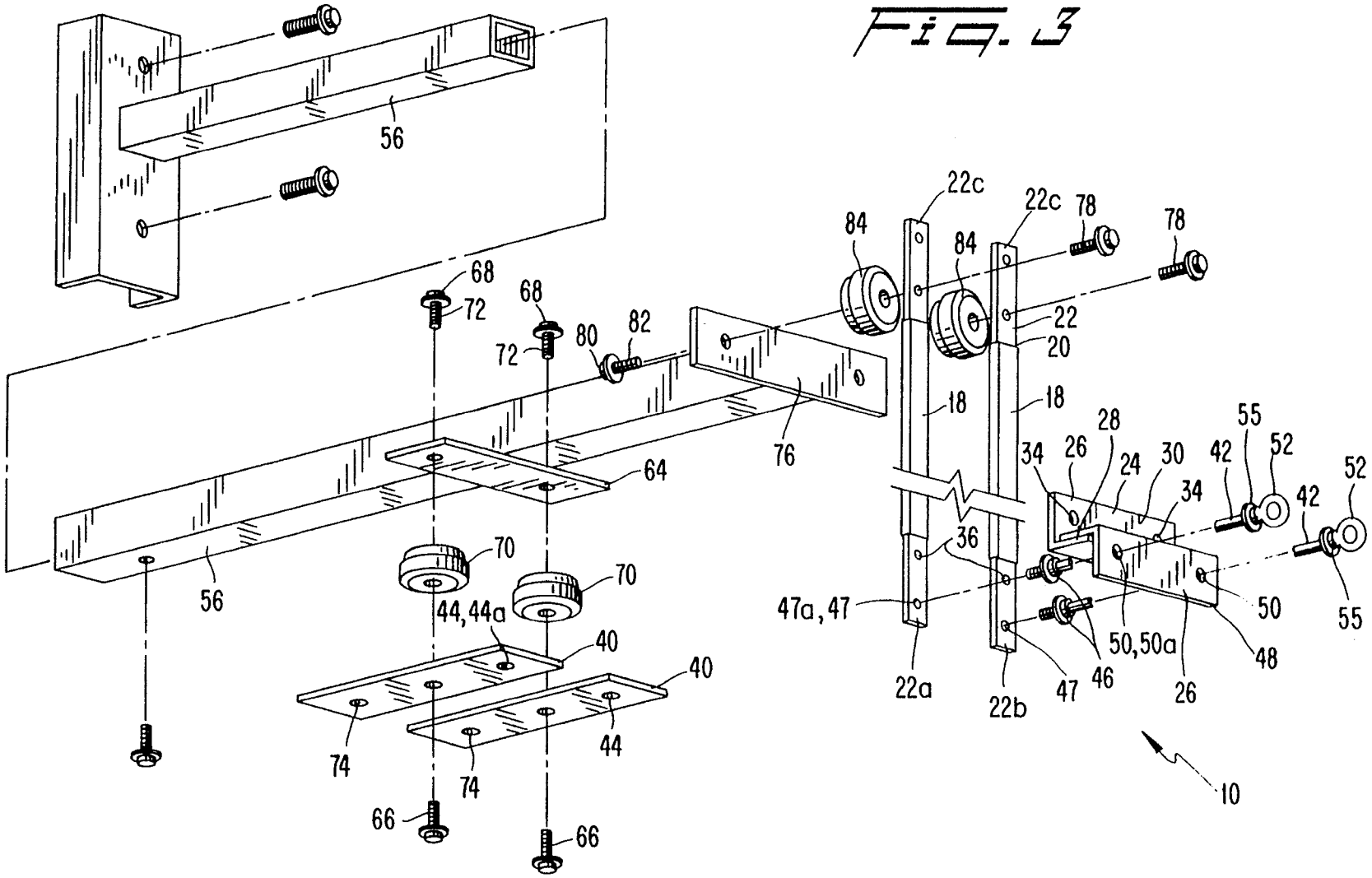
FIG. 3 shows an exploded view of FIG. 1 embodiment connector components.

Turning to the figures, a first embodiment connector 10 is shown in FIGS. 1-3 installed between secondary leads 12 of transformer 14 and service leads 16.

Each flexible braided conductor cable 18 has its ends 20 clamped within a conductive metal sleeve 22. Bar 24 of fiberglass, a non-conductive material, includes two angle members 26 fastened such that the bar has an overall "Z"-shaped cross-section. Overlapping legs of the angle members form the web 28 of bar 24. A first leg 30 of rigid bar 24 is secured between sleeves **22*a*, 22*b*, bar 24 thus acting as a spacer for cables 18. Headed bolts 32, inserted through apertures 34 of leg 30 and apertures 36 of sleeves 22*a*, 22*b*, secure the bar and sleeves together with nuts 38. Angle members 26, being of rigid non-conductive material such as fiberglass preclude electrical connection between cables 18** via the bar.

In the closed connector position of FIG. 2, sleeves **22*a*, 22*b* are releasably fastened in electrical contact with bus bars 40*a*, 40*b*, respectively, each of which is in turn in permanent electrical contact with a service lead 16. Each threaded bolt 42 is inserted through sleeve aperture 47 and into a threaded aperture 44 of a bus bar 40. The bolt has a first outwardly radially extending annular portion 46 axially spaced from the leading end of the bolt which annular portion abuts a sleeve 22 to releasably fasten the sleeve in place, in electrical contact with a bus bar. A second leg or flange 48 of the rigid bar has two apertures 50. Each bolt 42 has a ring 52 for rotation by a tool such as hot stick 54. There is a second radially extending annular portion 55 which abuts second leg 48 when bolt 42 is threaded fully into an aperture of the bus bar. In operation then, bolt 42 may be released from a fastened position through rotation by the hot stick. The bolt may be threaded into a bus bar aperture by use of the hot stick, since paired apertures 47***a*, 50*a*, for example, register with each other to axially align a bolt with its threaded aperture 44*a* once the sleeve and bus bar apertures are properly registered with each other. In FIG. 1, each switch including a bus bar 40, a fastener bolt 42 and flexible cable 18, is shown in an open position. Electrical contact between cables 18 is precluded by spacer bar 24 when the connector is in the open position.

Rigid metal arm 56 is mounted to utility pole 58 at its base 60 by screws 62. Bus bars 40 are secured to the underside of the arm on apertured lug 64 by means of bolts 66 and nuts 68 and insulated from electrical contact with the lug by insulator 70 and non-conductive bushing 72. Service leads 16 are connected via apertures 74.

Arm 56 includes apertured finger 76 for mounting of sleeves 22*c* by bolts 78, nuts 80 and insulating bushings 82, and insulators 84 such that sleeves 22*c* are electrically isolated from the finger. Transformer secondary leads 12 are secured by means of nuts 86 and bolts 88 through apertures of sleeves 22*c*. Each connector of the first embodiment thus includes a cable 18 having sleeves 22 at either end, and a bus bar 40 to electrically connect paired transformer and service leads 12, 16.

Mounting arm 56 includes axially adjustable limbs 90, 92 which may be properly located for connection of secondary leads 12 to sleeves 22*c*. Once properly located the limbs are secured relative to each other by set screw 94 which may be welded into place.

Figure 4:
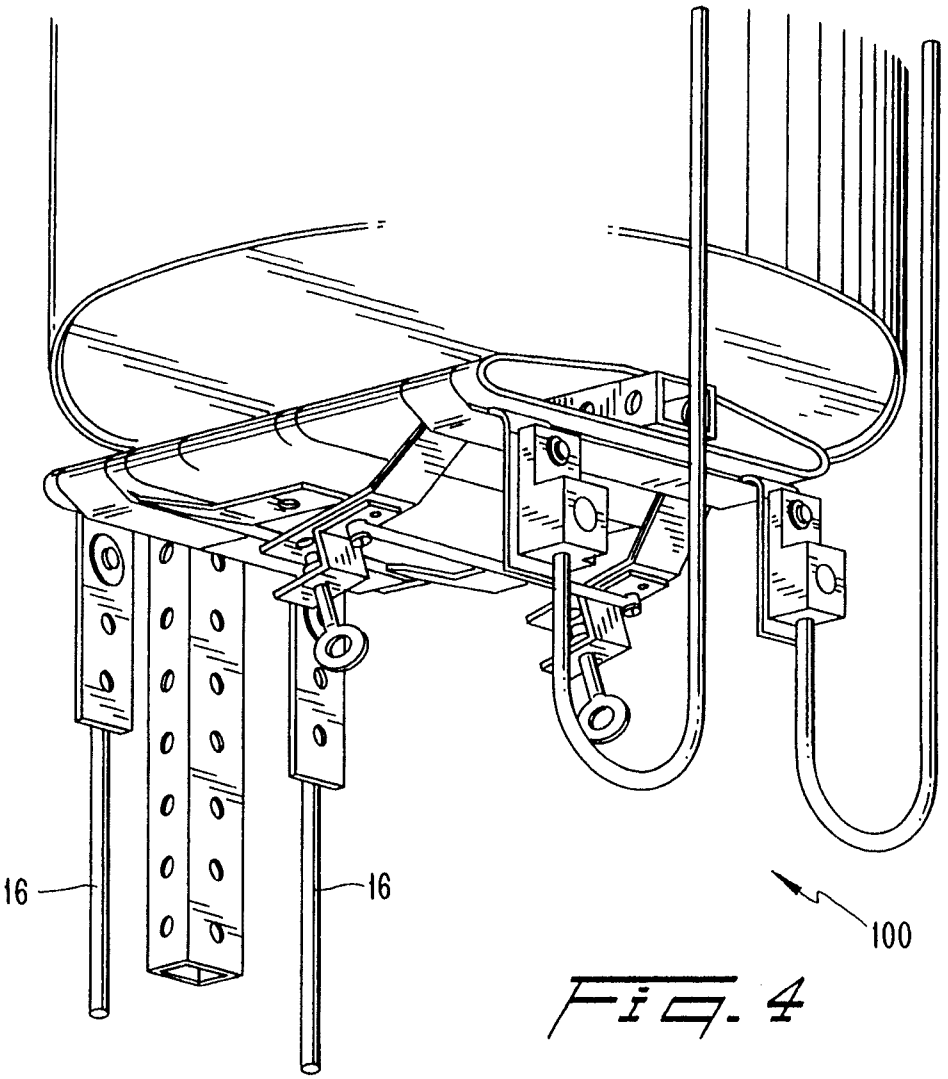
FIG. 4 shows a second preferred embodiment connector of the present invention installed with a conventional pole-mounted transformer, the connector being in an open position.
Figure 5:
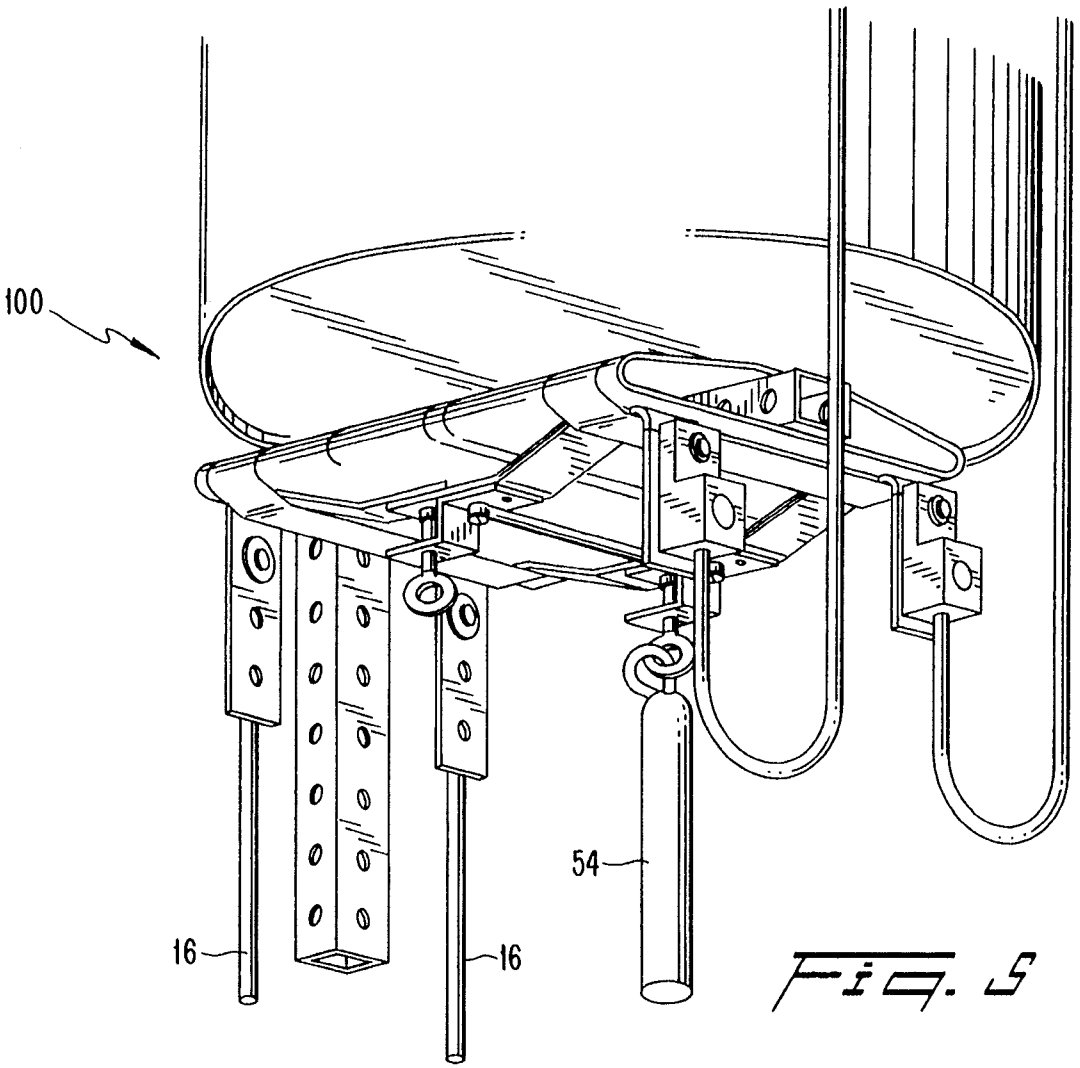
FIG. 5 shows the FIG. 4 embodiment in a closed position.
Figure 6:
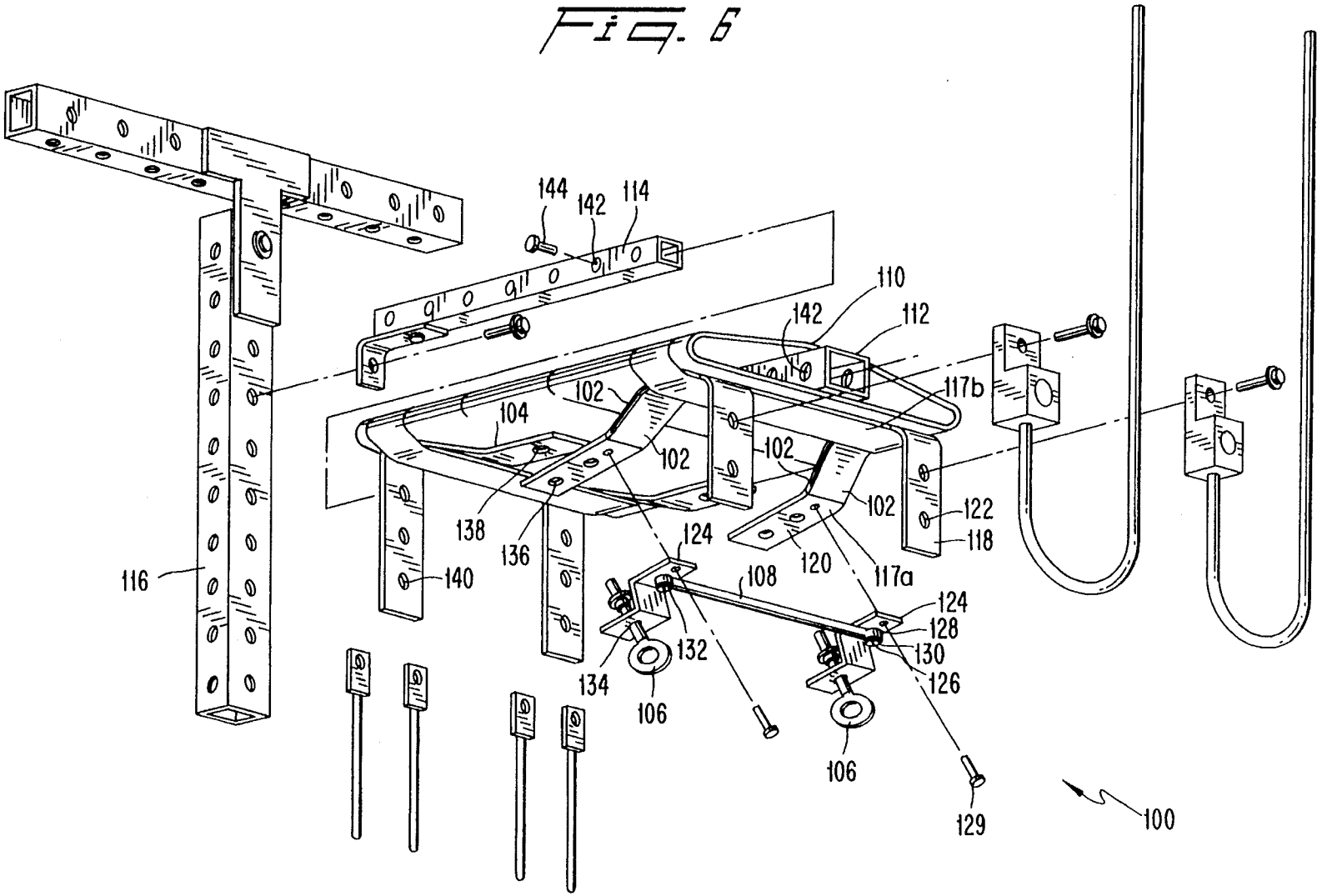
FIG. 6 shows an exploded view of FIG. 4 embodiment connector components.

A second preferred embodiment is shown in FIGS. 4–6. Connector 100 includes two switches, each including a flexible electrically conductive cable 102, rigid conductive bar 104 and a threaded fastener. Fiberglass spacer 108 precludes electrical contact of the flexible members with each other when the switches are in the open position of FIG. 1. Cable 102 and rigid bar 104 are mounted to fiberglass shroud 110. Encased in the hollow shroud is hollow bar 112 which telescopically receives rod 114 mounted on pole 116. Each switch includes two coextending braided cables. The lower of the two cables may be installed so as to have a slightly shorter length between fastening locations 117*a*, 117*b* than the upper cable, which arrangement tensions the lower cable with respect to the upper cable when the switch is in its closed position, i.e., creates an inherent bias of the combined cables away from the rigid conductive bar. The braided cables may be bent so as to tend to the position shown in FIG. 4.

More particularly, ends of each cable 102 are clamped within metal sleeves 118, 120. Apertures 122 are for electrical connection of transformer secondaries to the connector. A rigid metal Z-bar portion 124 is secured to each flexible cable and sleeve by bolt 126 and nut 128 and screw 129. Spacer 108 has hollow ends wrapped around bolts 126 and further secured thereto by nut 130 and washer 132. Each Z-bar portion has an aperture 134 which registers with aperture 136 such that threaded bolt 106 is properly postioned for threading into threaded aperture 138. Bolts 106 of this second embodiment are similar to those of bolts 42 of the first embodiment.

Each rigid conductive bar 104 has three apertures 140 for connection of service leads and the second embodiment may thus be connected to up to three services.

Hollow bar 112 and rod 114 each have holes 142. A pair of the holes may be registered with each other in positioning of the connector and a fastener 144 affixed to maintain the axially selected postion of the bar with respect to the rod.

It will be appreciated the the switches of the second embodiment, as with the first embodiment may be operated by service personnel standing on the ground through the use of a hot stick. The arrangement is such that the bolts for fastening the switches in closed positions do not fall to the ground when a switch in its open postion. Further, the apertures of a flexible member through which a bolt extends register with each other to orient a bolt for ready threading into a threaded aperture of the rigid bar of the switch with which the flexible cable is paired. The rigid spacer, in addition to maintaining the flexible cables in a spaced position to preclude shorting of the switches also maintains the flexible cables in position to locate apertures therein to register properly with the threaded apertures of the rigid bars. This serves to enhance proper threading of bolts 106 into threaded apertures 138 when a switch is being fastened into its closed position.

It will also be appreciated that a connector according to the present invention may be included as part of a freshly installed transformer, or may be used to retrofit a previously installed transformer.

The shroud of the second embodiment, in addition to providing a chassis for the connector serves to deter small animals, for example squirrels, from climbing onto the upper side of the conducting portions of the switches and thereby acting as a bridge therebetween. The shroud and other epoxy-bound fiber glass elements of the connector would of course be suitably coated to prevent degradation by sunlight, etc., as would be appreciated by those skilled in the art.

The foregoing embodiments illustrate practical aspects of the invention while the appended claims define the scope of protected subject matter.

What is claimed is:

1. A connector for installation between secondary leads of a pole-mounted transformer and service leads, comprising:

a pair of spaced apart switches, each switch having open and closed positions for electrical connection of paired secondary and service leads when in the closed position and for electrical isolation of the paired secondary and service leads when in the open position; and wherein:

each switch comprises a rigid conductive member paired with a flexible conductive cable and a releasable fastener for electrical connection of the cables to maintain the switch in the close position; and further comprising:

a spacer secured between the flexible cables to preclude electrical connection therebetween when each switch is in the open position.

2. The connector of claim 1 wherein the flexible member of each switch is biased away from the rigid cable with which it is paired when the switch is in the open position.

3. The connector of claim 2 wherein each flexible member comprises a pair of coextending cables wherein a first of the coextending cables is tensioned with respect to a second of the coextending cables so as to bias the flexible member away from the rigid member with which it is paired.

4. The connector of claim 1 wherein each paired member and cable has apertures which register with each other for insertion of the fastener through the apertures for maintaining the switch in the closed position.

5. The connector of claim 4 wherein:

the aperture of each rigid member of each switch is threaded and the fastener of the switch is matingly threaded with the threads of the aperture; and each switch further comprises:

a rigid portion connected to the flexible cable, which rigid portion has a flange with a hole therein spaced from the flexible cable and located to register with the aperture of the flexible cable for insertion of the fastener therethrough so as to position the fastener for threading into the aperture of the rigid member.

6. The connector of claim 5 further comprising an arm for mounting to the pole.

7. The connector of claim 6 wherein the arm is located so as to be above the switches when the connector is oriented such that the flexible cables are biased downwardly.

8. The connector of claim 7 wherein the rigid member of each switch further comprises a bus bar for connection to one of a said secondary and a said service lead, and the flexible member of each switch has electrically connected thereto a bus bar for connection to the other of a said secondary and a said service lead.

9. The connector of claim 8 wherein the bus bars depend downwardly.

10. The connector of claim 9 further comprising an electrically non-conductive member positioned to overly the spaced switches and deter entry of small animals to between the switches from above the connector.

11. The connector of claim 7 wherein each switch is oriented such that the rigid conductive member overlies the flexible cable with which it is paired when the switch is in the closed position.

12. The connector of claim 11 for use with a fastener turning tool wherein the fastener of each switch is a threaded bolt having a head and the bolt is of sufficient length to provide access to the tool for turning the bolt to fasten the switch in the closed position.

13. The connector of claim 12 wherein the bolt head of each switch includes a ring for turning by the tool and an outwardly extending radial portion axially spaced from its leading end and located between the flexible cable and the rigid portion connected thereto so as to sandwich the flexible cable between the radial portion and the rigid conductive member when the switch is in the closed position.

14. The connector of claim 7 wherein the arm is hollow for insertion of a horizontal pole-mounted rod therein.

15. The connector of claim 14 wherein the bar and rod have apertures which may be registered for receipt of a fastening device therethrough to axially fix the connector with respect to the rod.

16. The connector of claim 1 wherein each flexible cable includes a metal conductive first sleeve secured to a first end for making the electrical connection.

17. The connector of claim 16 wherein the spacer comprises a non-conductive bar secured between the sleeves.

18. The connector of claim 17 wherein each rigid member comprises a bus bar for electrical connection between one of the sleeves and a service lead.

19. The connector of claim 18 further comprising an arm for mounting to the pole below the transformer wherein the bus bars are affixed to an underside of the arm.

20. The connector of claim 19 wherein a said sleeve of each switch has an aperture therein for insertion of a said fastener therethrough for electrical connection of the sleeve to the bus bar of the switch when the switch is in the closed position.

21. The connector of claim 20 wherein the bus bar of each switch has a first aperture located to register with the aperture of the sleeve of the switch.

22. The connector of claim 21 wherein the bus bar apertures and fasteners are threaded for releasable engagement of each other.

23. The connector of claim 22 wherein the non-conductive bar has a "Z" shaped cross-section, a first leg of which bar is secured between the sleeves and a second leg of which has holes for insertion of said fasteners therethrough, located such that each hole registers with a sleeve aperture so as to axially align a said threaded fastener inserted therethrough for threading into a said threaded aperture of a said bus bar.

24. The connector of claim 23 wherein each threaded fastener is a metal bolt having a first outwardly radially extending portion axially spaced from its leading end and located to abut a said sleeve when the fastener is inserted through a said sleeve aperture and rotatingly threaded into a said threaded aperture of a said bus bar to fasten the sleeve and bus bar together.

25. The connector of claim 24 wherein each bolt includes a ring on its head for rotational engagement by a tool.

26. The connector of claim 25 wherein each bolt further comprises a second outwardly radially extending portion between its head and the second leg of the non-conductive bar, which second portion abuts the second leg of the non-conductive bar when the bolt is threaded into a said aperture of the bus bar.

27. The connector of claim 26 wherein each flexible conductive cable includes a metal conductive second sleeve secured to a second end for electrical connection to a said transformer lead.

28. The connector of claim 19 wherein the arm comprises a pair of metal axially adjustable members and the arm has a first end adapted for mounting to the pole.

29. A connector for installation between secondary leads of a pole-mounted transformer and service leads, comprising:

a pair of spaced apart switches, each switch comprising a rigid conductive member and a paired flexible conductive member, the switch having a closed position in which the members are in conductive contact and an open position in which the flexible member is moved from contact with the rigid member, wherein the members have registering apertures when in the closed position; and a fastener for each switch for insertion through the apertures to fasten the switch in the closed position; and wherein:

the aperture of each rigid member and fastener are matingly threaded; and the flexible member of each switch has a rigid portion connected to it, which rigid portion has a flange with a hole therein spaced from the flexible member and located such that the hole registers with the apertures of the paired flexible and rigid members when in the closed position for insertion of the fastener therethrough so as to align the fastener for threading into the aperture of the rigid member whereby the switch may be fastened in the closed position.

30. The connector of claim 29 wherein each threaded member further comprises an outwardly radially extending portion axially located between the flange and the flexible member to preclude withdrawal of the fastener from the aperture of the flexible member and hole of the rigid portion.

31. The connector of claim 29 wherein the threaded fastener of each switch further comprises an outer annular portion axially located to abut the flexible member when the switch is in the closed position so as to sandwich the flexible member between the annular portion and the rigid member.

32. The connector of claim 31 wherein the outwardly radially extending portion comprises the annular portion.

33. The connector of claim 32 wherein the fastener has a head including a ring for rotation of the fastener by a tool whereby the fastener may be threaded into or out of the aperture of the rigid member thereby.

* * * * *